United States Patent [19]

Andersson

[11] Patent Number: 4,477,313

[45] Date of Patent: Oct. 16, 1984

[54] METHOD AND APPARATUS FOR PRODUCING A MULTILAYER PAPER WEB

[75] Inventor: Anders I. Andersson, Hammarö, Sweden

[73] Assignee: Aktiebolaget Karlstads Mekaniska Werkstad, Karlstad, Sweden

[21] Appl. No.: 421,043

[22] Filed: Sep. 22, 1982

[30] Foreign Application Priority Data

Dec. 3, 1981 [SE] Sweden ..... 8107215

[51] Int. Cl.³ ..... D21H 1/02; D21F 1/66

[52] U.S. Cl. ..... 162/123; 162/190; 162/264; 162/301

[58] Field of Search ..... 162/123, 129, 301, 298, 162/264, 132, DIG. 7, 189, 190

[56] References Cited

U.S. PATENT DOCUMENTS

| | | | |
|---|---|---|---|
| 3,455,780 | 7/1969 | Hazard et al. | 162/301 |
| 3,846,232 | 11/1974 | Kankaanpaa . | |
| 3,923,593 | 12/1975 | Verseput | 162/301 |
| 3,951,736 | 4/1976 | Kobayashi | 162/301 |
| 4,267,017 | 5/1981 | North | 162/190 |

FOREIGN PATENT DOCUMENTS

| | | |
|---|---|---|
| 1021506 | 11/1977 | Canada . |
| WO82/00072 | 10/1982 | PCT Int'l. Appl. . |
| 882979 | 12/1957 | United Kingdom . |
| 1385262 | 5/1972 | United Kingdom . |
| 1006567 | 4/1962 | United Kingdom . |
| 1376518 | 10/1972 | United Kingdom . |
| 1352672 | 5/1974 | United Kingdom . |
| 1411773 | 10/1975 | United Kingdom . |

OTHER PUBLICATIONS

Simultaneous Forming of Multi-Layer Products—Some Problems and How to Solve Them, Ingmar Andersson, Paper Presented at Focus 82, Mar. 3-5, 1982, Loew's L'Enfant Plaza, Washington, D.C.

*Primary Examiner*—Peter Chin

*Attorney, Agent, or Firm*—Bell, Seltzer, Park & Gibson

[57] ABSTRACT

In the production of multi-ply paper in a twin-wire former of the kind in which the wires define a curved forming zone, preferably a former of roll type with a smooth-faced forming roll, a substantially improved layer purity is produced in that the discharges from a first and at least succeeding portion of the curved forming zone are collected separately as different fractions. The first fraction collected nearest the multilayer headbox is returned in a first separate circuit to be used for diluting a first high consistency pulp to a first stock of headbox consistency, from which stock a first layer is to be formed directly on the outer wire in relation to the curved forming zone. At least a portion of a second fraction collected at a greater distance from the multilayer headbox is returned in a second separate circuit to be used for diluting a second high consistency pulp to a second stock of headbox consistency, from which a second layer is to be formed superimposed on the first layer.

10 Claims, 1 Drawing Figure

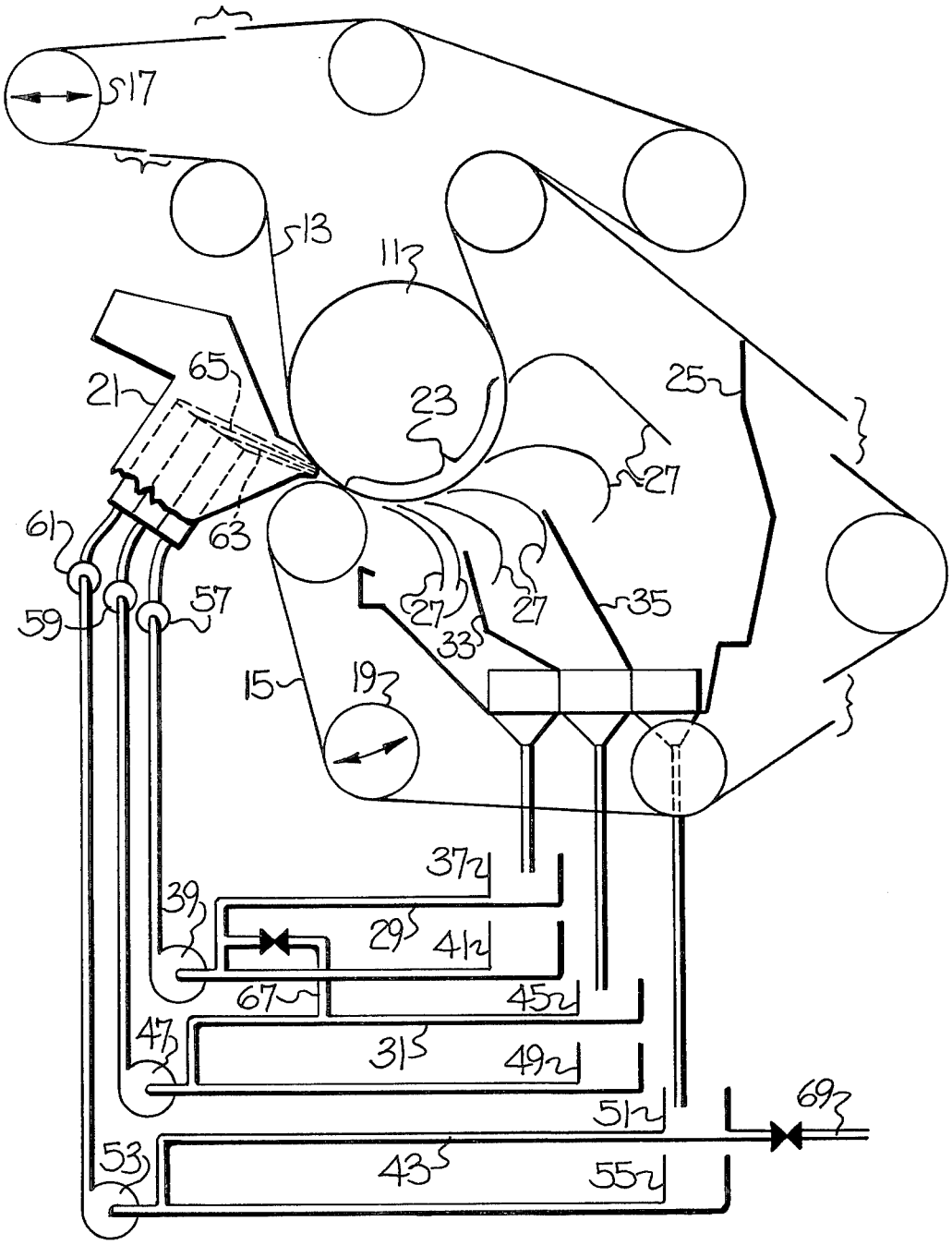
17
13
11
21
65
23
25
27
61
63
59
57
27
27
35
33
15
19
37
39
29
41
67
45
47
31
49
51
69
53
43
55

METHOD AND APPARATUS FOR PRODUCING A MULTILAYER PAPER WEB

FIELD AND BACKGROUND OF THE INVENTION

The present invention relates to a method for producing a multilayer paper web in a twin-wire former of the kind in which the wires define a curved forming zone, to which at least two different stocks are delivered from a multilayer headbox, and from which forming zone white water is ejected, collected and substantially returned to the papermaking process.

The invention also relates to an apparatus for producing a multilayer paper web for realization of the method, including a twin-wire former of the kind in which the wires define a curved forming zone, a multilayer headbox for delivering at least two different stocks to the curved forming zone, and means for collecting and returning to the papermaking process at least a substantial portion of the white water ejected from the curved forming zone during the forming of the multilayer paper web.

The expression "forming zone" is used herein in the meaning generally accepted in the art, i.e. a zone extending from the point where dewatering of the stock through at least one wire begins up to the point where dewatering has progressed so far that the fibers forming the paper web can no longer float around in the suspension liquid, but bear against each other substantially immovably.

Water that is separated from a fiber suspension or fiber mat in a paper machine is called white water. White water usually contains fiber residues, sometimes also filler, dyes, rosin-size and the like, and is generally returned to the papermaking process. The flow circuit that is arranged for the return of white water to the process, and which comprises piping, storage containers, cleaning means and control equipment for the return flow, is usually called a white water system. A white water system is said to be open if a major portion of the total white water flow leaves the system and is said to be closed if only a small portion of the total white water flow leaves the system. A flow circuit for so-called short white water around a former is called a short circulation, and the term "short white water" refers to white water that is returned to the stage of the process from which it originated. Analogously, the term long circulation refers to flow circuit for so-called long white water, i.e. white water that is returned to a process stage other than the one from which it was separated.

The white water that is returned in a short circulation is used to dilute the stock from a higher consistency to headbox consistency, e.g. in newsprint making from above 2.5 percent by weight to below 1 percent by weight, and this return takes place without cleaning of the white water. At newsprint mills with Fourdrinier machines it is known that white water separated at the end of the Fourdrinier section has a considerably lower content of suspended matter than that of white water separated at the beginning of the Fourdrinier section. Compare for example, GB No. 1,352,672 and CA No. 1,021,506. This cleaner white water is returned as a rule in a long circulation to the mill grinder room, but part of it can be conducted to a final cleaning before discharge into a suitable receiving body of water. It is also known to divide up the white water from a Fourdrinier machine into three fractions with a purity increasing towards the end of the Fourdrinier section, with the cleanest fraction being conducted for final cleaning. The technical aspects of system design and closure of systems for newsprint machines of Fourdrinier type are given in a report "Skogsindustrins miljovardsprojekt" ("Forest Industry Environmental Project") from SSVL, Stiftelsen Skogsindustriernas vatten- och luftvards-forskning (The Water and Air Pollution Research Foundation of the Swedish Forest Industries), pages 151–155 and 178–190.

Further, a roll type twin-wire machine is disclosed in U.S. Pat. No. 3,846,232 in which the forming zone curves along the shell face of a forming roll of suction roll type. The forming zone is followed by a slightly curved dewatering zone with a maximum length of about three times the diameter of the forming roll. In order to obtain the slight curve, the inner wire is supported along the dewatering zone by several guiding means, such as rotatable rolls or one or more fixed and narrow foils or deflectors. It is stated that white water separated at the forming roll is collected in a first saveall and a second saveall, which are located on either side of the wires, and the white water is conducted to the intake of the mixing pump for the headbox to be used as dilution water. It is also stated that white water which is separated from the formed paper web downstream of the forming zone and which usually has a lower content of fibers than white water from the forming roll, is collected in separate savealls to be conducted to a point in the water system where a lower fiber content is desired.

Due to the forced drainage of the stock at a forming roll as compared with a Fourdrinier section, the content of suspended matter in the excess white water will be higher at the forming roll, and compared with white water from the end of the Fourdrinier section, white water from the forming roll can have a content of suspended matter that is more than 50 percent higher. When making multi-ply paper in a twin-wire former of roll type the white water can therefore be comparatively rich in fiber and contain both long and short fibers. In cases where it is desired to make a multi-ply paper with at least one layer of long fibers and at least one layer of short fibers and to dilute long-fiber thick stock and short-fiber thick stock with white water to form stocks of predetermined headbox consistencies, and wherein the white water used for dilution is rich in both short and long fibers, no appreciable layer purity can be attained. The layer of short fibers will contain a large proportion of long fibers and the layer of long fibers a large proportion of short fibers. This unfavorable result can be made still worse if the headbox is not of the kind that keeps the stocks separated not only through the headbox but also for a distance downstream of its slice openings for the stocks. At worst, the layer purity will have been reduced so much that when determining the proportion of long fibers and the proportion of short fibers in the layers by counting the fibers, no conclusive difference can be established between the different layers.

SUMMARY OF THE INVENTION

The object of the present invention is to produce in a twin-wire former with a curved forming zone a multilayer paper web with considerably improved layer purity.

According to one aspect of the invention, this object is achieved, in the method described in the introduction, by collecting separately as different fractions the discharges from a first portion and at least one succeeding portion of the curved forming zone, returning in a first separate circuit the first fraction collected nearest the headbox to be used for dilution of a first thick stock to form a first stock of headbox consistency from which a first layer is to be formed directly on the outer wire in relation to the curved forming zone, and returning in a second separate circuit at least a portion of a second fraction collected at a greater distance from the headbox to be used for dilution of a second thick stock to form a second stock of headbox consistency, from which a second layer superimposed on the first layer is to be formed.

According to a second aspect of the invention, this object is achieved, in the apparatus described in the introduction, in that said means for collecting and returning white water comprises devices for collecting separately as different fractions the discharges from a first portion and at least one succeeding portion of the curved forming zone, means defining a first separate circuit for returning the first fraction, collected nearest the headbox, to be used for dilution of a first thick stock to form a first stock of headbox consistency, from which a first layer is to be formed directly on the outer wire in relation to the curved forming zone, and a second separate circuit for returning at least a portion of a second fraction, collected at a greater distance from the headbox to be used for dilution of a second thick stock to form a second stock of headbox consistency, from which a second layer superimposed on the first layer is to be formed.

An improvement of the layer purity makes it possible to produce new paper grades, which were previously out of the question. Firstly, the mechanical properties of the paper can be improved. For example, a soft and flexible tissue can be produced with a strong middle layer of long-fiber pulp and soft outer layers of short-fiber pulp, or a printing paper which, despite its low basis weight, is comparatively stiff due to two strong outer layers of long-fiber material enclosing a weaker middle layer of short-fiber material. Secondly, cheaper raw materials can be used for some paper grades. For example, the middle layer can sometimes consist of recycled fibers, while the outer layers are composed of prime fibers. Thirdly, in the production of some paper grades, advantages with respect to the process can be obtained, such as improved runability for the machine. For example, in the manufacture of two-ply tissue, the side of the tissue web making contact with the Yankee dryer can consist of pine kraft pulp in order to attain good adherence of the web to the dryer, and the other side of the tissue web can consist of groundwood pulp, which usually causes increased wear on the edge of the creping doctor blade, but will not come into contact with the blade in this case.

Preferably, a machine-width baffle is provided in the white water saveall that collects the discharge from the forming zone and is placed in a location such that the first white water fraction will not be larger than that the whole of it will be used up in diluting the first thick stock for formation of the first stock of a predetermined headbox consistency. Thereby the whole of the fiber content can be returned in a short circulation to the first thick stock for dilution of this to the stock from which the first layer deposited directly on the outer wire shall be formed. If, for example, this layer consists of long-fiber pulp, the first fraction will contain long fibers which will all be returned to the correct headbox channel.

If the first fraction is not sufficiently large to permit the desired dilution of the thick stock, it is suitable that a dilution water increment be supplied from the white water in the second fraction or from the white water in a still later fraction, if this should be richer with respect to correct kind of fibers and leaner with respect to incorrect kind of fibers. In order to provide the greatest possibility of fractionated collection of the white water, it is suitable that the twin-wire former is of roll type and has a smooth-faced forming roll along the face of which the forming zone is curved. Thereby only a negligible quantity of white water will pass through the inner wire, so that all the white water removed from the forming zone will be ejected from the outer wire during one-sided dewatering of the stocks squeezed between the wires.

Preferably, the headbox includes at least one machine-width separator vane which keeps two stocks separated when these are delivered from the headbox. A headbox of this kind is disclosed, for example, in CA No. 1,107,111 and provides a particularly effective contribution towards the desired high layer purity.

BRIEF DESCRIPTION OF THE DRAWING

The invention will now be described in more detail with reference to an accompanying drawing, which is a diagrammatic sketch of the wet end of a twin-wire machine with associated flow circuits for short white water constructed in accordance with a preferred embodiment of the invention.

DETAILED DESCRIPTION OF ILLUSTRATED EMBODIMENT

The twin-wire former shown in rough outline in the drawing is of roll type and comprises a rotatable forming roll 11, which is a roll with smooth shell face in the embodiment shown, an inner wire 13 running in an endless loop around the forming roll 11 and supported by a portion of the forming roll, and an outer wire 15 which also runs in an endless loop and is supported via the inner wire 13 by said portion of the forming roll 11. The wires 13 and 15, which are kept tensioned by means of stretch rolls 17 and 19, run together on the forming roll 11 while forming a space converging in the direction of rotation for receiving a multilayer stock jet from a multilayer headbox 21. The stocks are dewatered by squeezing between the tensioned wires 13 and 15 as these wires follow the circumference of the rotating forming roll 11, whereby a web of paper is formed. The zone between the point where the dewatering commences and the point where the fibers can no longer float around in the stock, but are substantially immovable in relation to each other, is called a forming zone. The forming zone 23 curves along the shell face of the forming roll 11. The suspension liquid that is expressed through the outer wire 15 owing to the squeezing of the stocks between the wires 13 and 15 is removed by being ejected due to the rotation of the roll 11 and is caught in a white water saveall 25 arranged inside the loop of the outer wire 15. An expression of suspension liquid or white water through the inner wire 13 is prevented by the smooth face of the forming roll 11. The discharge is caught and deflected by means of machine-width curved baffle plates 27 arranged in the white water saveall 25 and with a perforated trailing edge similar to what has been described in U.S. Pat. No. 4,028,174. The drawing also shows that the saveall 25 is included in what can be characterized as means for collecting and returning to the papermaking process at least a substantial portion of the white water ejected from the curved forming zone 23 during the forming of the multilayer paper web.

According to the invention, the discharges from a first and at least one succeeding portion of the curved forming zone 23 are collected as separate fractions. The first fraction collected nearest the headbox 21 is returned in a first separate circuit 29 to be used for dilution of a first thick stock for formation of a first stock of headbox consistency, from which a first layer is to be formed directly on the outer wire 15 in relation to the curved forming zone 23. At least a portion of a second fraction collected at a greater distance from the headbox 21 is returned in a second separate circuit 31 to be used for dilution of a second thick stock for formation of a second stock of headbox consistency, from which a second layer superimposed on the first layer is to be formed.

For realization of this method said white water collecting and returning means comprise on one hand devices for collecting separately as different fractions the discharges from said portions of the curved forming zone 23, and on the other hand said first separate circuit 29 and said second separate circuit 31. In the preferred embodiment shown in the drawing, said devices comprise a machine-width baffle 33 arranged in the white water saveall 25 and extending down to the bottom of the saveall and also dividing the outlet from the saveall 25 so that the fractions are not unintentionally intermixed. The drawing also shows a second baffle 35 for dividing fractions and located at a greater distance from the headbox than the baffle 33, but otherwise similar to design and function.

The baffles 33 and 35 divide the discharges from the forming zone 23 into three separate fractions. The first fraction is conducted through the first circuit 29 which comprises a white water tank 37 and a mixing pump 39, in which said first thick stock from a thick stock chest 41 is mixed with the first white water fraction to form the first stock of predetermined headbox consistency. In a corresponding way the second and the third fractions are conducted through the second circuit 31 and a similar third circuit 43, which each comprise a white water tank 45 and 51, respectively, and a mixing pump 47 and 53, respectively. In the pump 47 said second thick stock from a thick stock chest 49 is mixed with the second white water fraction to form the second stock of a predetermined headbox consistency, and in pump 53 a third thick stock from a thick stock chest 55 is mixed with the third white water fraction to form a third stock of a predetermined headbox consistency. From the mixing pumps 39, 47 and 53 the stocks pass to separate cross distributors 57, 59 and 61, respectively, which extend across the machine direction and have a cross section diminishing in the direction of flow to deliver to the headbox 21 a stock flow evenly distributed along its width across the machine direction.

In the preferred embodiment shown, the headbox 21 is a three-layer headbox, which is preferably of the kind disclosed in CA No. 1,107,111. The three stocks run separately through the headbox, which has a slice chamber that converges towards a slice opening. The slice chamber is divided by two machine-width separator vanes 63 and 65 into three slice channels, one for each stock. The vanes 63 and 65 are rigid and thick, and each has been designed to permit an air wedge, not shown, to be produced at its downstream end, which projects out of the slice opening. These air wedges keep the stocks separated from each other after discharge through the slice opening for a further distance in a direction towards the forming zone. By delaying the commencement of a mixing of at least the boundary layers between the stock jets, a substantial increase of layer purity will be obtained. A further improvement can usually be produced if a vane extension, not shown, suitably a relatively rigid one in the form of a foil of slightly greater length than the air wedge, is anchored at the downstream end of the vane in order to prevent the kinetic components of the stock jets directed towards each other when the jets gradually meet at the tip of the air wedge from causing an undesirable intermixing. If desired, a foil like this can extend as far as into the forming zone 23. A limitation of its length is fixed by the risk of the foil being squeezed between the wires 13 and 15 and pulled along with them.

The first baffle 33 in the white water saveall 25 is preferably located in a position such that the first white water fraction will not be larger than that the whole of it will be used up to dilute the first thick stock for formation of the first stock of the predetermined headbox consistency. In case the position of the baffle 33 is such that the first fraction is not sufficiently large to produce the desired dilution of the thick stock, it is suitable that means 67 are arranged to permit a controllable flow of white water to the first fraction from usually the second fraction, but in some cases the third fraction.

As more water is supplied to the wet end by the thick stocks than that removed as water in the newly formed wet paper web when this leaves the wet end, there will be an excess of white water. This is removed in the embodiment shown through a pipe 69 fitted with a valve and connected to the white water tank 51 of the third circuit, as the third fraction usually contains the lowest proportion of valuable fibers.

The preferred embodiment of the invention described above and shown in the drawing is only an illustrative example of the application of the invention in practice. Thus the invention is not restricted to said preferred embodiment but several variations and modifications thereof, obvious to a skilled art worker, are conceivable within the scope of the appended claims. For example, the white water tanks 37, 45 and 47 can be built together into a single large tank in which partitions keep the different white water functions separated. It can also be suitable in this case that the means 67, shown as a pipe with valve for supplementing the first fraction, if necessary, with a white water increment from the second fraction, consist instead of a gate, weir or similar device arranged in one of the partitions of the tank.

In the production of three-ply paper it is also usual that the two outer layers are formed from one and the same stock. For this, the thick stock chests 41 and 55 can be combined into a single chest from which the stock passes to a single mixing pump common to both outer channels of the headbox 21. The first white water fraction is used together with a requisite portion of the third in order to produce the dilution of the thick pulp to desired stock consistency for the outer channels. The remaining portion of the third white water fraction is suitably returned as long white water to the thick stock preparation.

If a two-ply paper shall be produced in the shown former, the chests 41 and 49 or 49 and 55 can be supplied with thick stock from a common source. Alternatively, either the baffle 33, the first circuit 29 and the thick stock chest 41, or the baffle 35, the third circuit 43 and the thick pulp chest 55 can be dispensed with, while the three-layer headbox 21 with two vanes 63 and 65 is replaced by a two-layer headbox with one single vane of this kind.

Although the greatest effect of the invention is obtained when the twin-wire former is of roll type and has a forming roll with smooth shell face, the invention will lead to increased layer purity even in applications where the forming roll is grooved in the circumferential direction or is a suction roll. Those skilled in the art will readily realize that the invention can be adapted to all twin-wire formers with a curved forming zone, e.g. of the kind shown in CA No. 960,496, in order to produce an improvement of the layer purity of the paper produced in this kind of former.

That which is claimed is:

1. A method for producing a multilayer paper web in a twin-wire former of the kind in which an outer wire and an inner wire define a curved forming zone, to which at least two different stocks are delivered from a multilayer headbox, and from which forming zone white water first passes out through the outer wire and then is thrown outwardly, collected and substantially returned to the papermaking process, said method comprising collecting separately as different fractions the white water discharged through the outer wire from a first portion and at least one succeeding portion of the curved forming zone, returning in a first separate circuit the first fraction collected nearest the headbox and mixing it with a first thick stock to form a first stock of headbox consistency, from which a first layer is to be formed directly on the outer wire in relation to the curved forming zone, and returning in a second separate circuit at least a portion of a second fraction collected at a greater distance from the headbox and mixing it with a second thick stock to form a second stock of headbox consistency, from which a second layer, superimposed on the first layer, is to be formed.

2. A method according to claim 1, further comprising adjusting the quantity of the first fraction to make it no larger than the quantity required to dilute the first thick stock to the first stock of a predetermined headbox consistency.

3. A method according to claim 2, wherein in addition to the dilution of the first thick stock with the first white water fraction for the formation of the first stock, a further dilution is necessary for the predetermined headbox consistency to be obtained, and comprising the step of making such further dilution with white water from the second fraction.

4. A method according to any one of claims 1 to 3, comprising allowing only a negligible quantity of white water to pass through the inner wire in the curved forming zone, whereby all white water removed from the forming zone is ejected from the outer wire during one-sided dewatering of the stocks.

5. A method according to any one of claims 1 to 3, comprising keeping the stocks separated from each other when delivering them from the headbox.

6. In an apparatus for producing a multilayer paper web, including a twin-wire former of the kind in which an outer wire and an inner wire define a curved forming zone, a multilayer headbox positioned for delivering at least two different stocks to the curved forming zone, and means for collecting and returning to the papermaking process at least a substantial portion of the white water that first passes out through the outer wire and then is thrown outwardly from the curved forming zone during the forming of the multilayer paper web, the improvement wherein said means for collecting and returning white water comprises means for collecting separately as different fractions the white water discharged through the outer wire from a first portion and at least one succeeding portion of the curved forming zone, means defining a first separate circuit for returning the first fraction collected nearest the headbox and for mixing it with a first thick stock to form a first stock of headbox consistency, from which a first layer is to be formed directly on the outer wire in relation to the curved forming zone, and means defining a second separate circuit for returning at least a portion of a second fraction collected at a greater distance from the headbox and for mixing it with a second thick stock to form a second stock of headbox consistency, from which a second layer superimposed on the first layer is to be formed.

7. Apparatus according to claim 6, wherein said means for collecting separately as different fractions the discharges from a first portion and at least one succeeding portion of the curved forming zone comprise a machine-width baffle located in a position such that the first white water fraction at most will be so large that it will be used up in its entirety in diluting the first thick stock for formation of the first stock of a predetermined headbox consistency.

8. Apparatus according to claim 7, additionally including means for permitting a controllable flow of white water from the second fraction to the first fraction.

9. Apparatus according to any one of claims 6 to 8, wherein the twin-wire former is of roll type and has a smooth-faced forming roll along the face of which the forming zone is curved, whereby only a negligible quantity of white water passes through the inner wire and thus all the white water removed from the forming zone is ejected from the outer wire during one-sided dewatering of the stocks.

10. Apparatus according to any one of claims 6 to 8, wherein the headbox comprises at least one machine-width separator vane which keeps two stocks separated when these are delivered from the headbox.

* * * * *